US009833826B2

(12) United States Patent
Urabe

(10) Patent No.: US 9,833,826 B2
(45) Date of Patent: Dec. 5, 2017

(54) PRESS FORMING METHOD

(71) Applicant: JFE STEEL CORPORATION, Tokyo (JP)

(72) Inventor: Masaki Urabe, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 285 days.

(21) Appl. No.: 14/648,534

(22) PCT Filed: Dec. 27, 2013

(86) PCT No.: PCT/JP2013/085227
§ 371 (c)(1),
(2) Date: May 29, 2015

(87) PCT Pub. No.: WO2014/132545
PCT Pub. Date: Sep. 4, 2014

(65) Prior Publication Data

US 2015/0290694 A1 Oct. 15, 2015

(30) Foreign Application Priority Data

Feb. 28, 2013 (JP) ..... 2013-038314

(51) Int. Cl.
*B21D 19/08* (2006.01)
*B21D 22/26* (2006.01)
*B21D 22/20* (2006.01)

(52) U.S. Cl.
CPC ..... *B21D 19/08* (2013.01); *B21D 22/26* (2013.01); *B21D 22/20* (2013.01)

(58) Field of Classification Search
CPC ..... B21D 19/08; B21D 22/02; B21D 22/20; B21D 22/201; B21D 22/22; B21D 22/26; B21D 19/082; B21D 19/10; B21D 22/30
See application file for complete search history.

(56) References Cited

U.S. PATENT DOCUMENTS 1,752,073 A * 3/1930 Foster, Jr. ..... B21D 53/74 72/379.2
3,771,342 A * 11/1973 Alleaume ..... B21D 5/00 493/405

(Continued)

FOREIGN PATENT DOCUMENTS

CN 101372025 A 2/2009
CN 102791396 A 11/2012

(Continued)

OTHER PUBLICATIONS

Translation JP2-205215A, Aug. 1990.*

(Continued)

*Primary Examiner* — Edward Tolan
(74) *Attorney, Agent, or Firm* — Oliff PLC

(57) ABSTRACT

A press forming method presses and forms a formed part including: a top portion having a projecting outer edge, a part of the projecting outer edge projecting outward; and a flange portion that formed by bending along the projecting outer edge of the top portion. The press forming method includes: a first forming step of forming, at a region of a blank material in which the flange portion is to be formed, a preformed part including a vertical wall portion to be a part of the flange portion and a trough portion that is bent outward from the vertical wall portion and recessed on a side of the top portion; and a second forming step of forming the flange portion by bending a region including the trough portion of the preformed part formed in the first forming step.

3 Claims, 15 Drawing Sheets

(56) References Cited

U.S. PATENT DOCUMENTS

| | | | | |
|---|---|---|---|---|
| 5,735,163 | A * | 4/1998 | Sato | B21D 22/201 72/348 |
| 8,056,385 | B2 | 11/2011 | Okuzumi et al. | |
| 2004/0200256 | A1* | 10/2004 | Chu | B21D 22/02 72/379.2 |
| 2012/0297853 | A1 | 11/2012 | Tanaka et al. | |
| 2015/0298193 | A1* | 10/2015 | Urabe | B21D 19/08 72/379.2 |

FOREIGN PATENT DOCUMENTS

| | | | | | |
|---|---|---|---|---|---|
| EP | 0916429 | A1 | | 5/1999 | |
| JP | S61-27125 | A | | 2/1986 | |
| JP | S62-107827 | A | | 5/1987 | |
| JP | 62-270226 | A | * | 11/1987 | B21D 24/16 |
| JP | 1-113130 | A | * | 5/1989 | B21D 24/04 |
| JP | 2-205215 | A | * | 8/1990 | B21D 5/01 |
| JP | 6-31351 | A | * | 2/1994 | B21D 22/20 |
| JP | H07-39954 | A | | 2/1995 | |
| JP | 2004-188445 | A | | 7/2004 | |
| JP | 2007-253173 | A | | 10/2007 | |
| JP | 2010-201486 | A | | 9/2010 | |

OTHER PUBLICATIONS

Translation JP62-270226A, Nov. 1987.*
Feb. 3, 2016 Search Report issued in European Patent Application No. 13876639.9.
Jan. 6, 2016 Office Action issued in Chinese Patent Application No. 201380069720.7.
Apr. 1, 2014 International Search Report issued in International Patent Application No. PCT/JP2013/085227.

* cited by examiner

PRESS FORMING METHOD

FIELD

The present invention relates to a press forming method that forms a shrink flange by performing press forming on a metal sheet.

BACKGROUND

When a flange portion is formed on a metal sheet by press forming along a projecting outer edge a part of which projects outward, there are cases in which shrinkage deformation arises in an end portion of the projecting portion of the flange portion. This is referred to as shrink-flanging. In the case of minor shrink-flanging, its influence is limited to only a phenomenon of an increase in sheet thickness. However, when the amount of shrink-flanging increases, wrinkles are formed in the course of press forming and the wrinkles remain after press forming.

The wrinkles are undesirable because they can cause shape defects of press formed products and wastage of dies. In particular, when the shrinkage is intense and large wrinkles are formed, the wrinkles further cause cracks of press forming on the metal sheet. Various methods have been developed that avoid the forming of wrinkles caused by such a shrink flange. For example, Patent Literature 1 discloses a method that facilitates compressive forming of a shrink flange portion by providing through-holes in the shrink flange portion in advance. Patent Literature 2 discloses a method of preventing wrinkles by clamping, at least at an early phase of press forming, a part of a press formed product, on which shrink-flanging is performed, at near its end portion with a U-shaped block and performing press forming afterward. Patent Literature 3 discloses a method of dispersing deformation by elaborating the shape of the end portion of a bending tool.

CITATION LIST

Patent Literature

Patent Literature 1: Japanese Laid-open Patent Publication No. 2007-253173

Patent Literature 2: Japanese Laid-open Patent Publication No. 07-039954

Patent Literature 3: Japanese Laid-open Patent Publication No. 2010-201486

SUMMARY

Technical Problem

In the method of providing through-holes in the flange portion disclosed in Patent Literature 1, however, the external appearance, strength, and sealing property of the final product are affected because non-uniform preliminary forming is performed on a metal sheet, and when the blank material is a surface-treated steel sheet (galvanized steel sheet), rust-prevention is further affected. Hence, the region to which the method can be applied is limited. In the method disclosed in Patent Literature 2, the structure of the tool of press forming to restrain the periphery of the shrink flange portion is complicated, and it is disadvantageous in terms of the fabrication of the tool and the cost of maintenance. In the method disclosed in Patent Literature 3, the elaboration in the complicated shape of the tool is required. Because it further appears that the end portion of the bending tool does not act effectively unless the bending angle of the metal sheet at the time of press forming is close to 90 degrees, it is disadvantageous in that it is not applicable when the bending angle of the metal sheet is small.

An object of the present invention is to provide a press forming method that can fundamentally solve the problem of potential wrinkles in shrink-flanging without any adverse effects on final products.

Solution to Problem

A press forming method according to the present invention is a press forming method of pressing and forming a formed part including: a top portion having a projecting outer edge, a part of the projecting outer edge projecting outward; and a flange portion that formed by bending along the projecting outer edge of the top portion, and includes: a first forming step of forming, at a region of a blank material in which the flange portion is to be formed, a preformed part including a vertical wall portion to be a part of the flange portion and a trough portion that is bent outward from the vertical wall portion and recessed on a side of the top portion; and a second forming step of forming the flange portion by bending a region including the trough portion of the preformed part formed in the first forming step.

In the above-described press forming method according to the present invention, the first forming step clamps a region of the blank material to be the top portion with a pad and a first die and forms a region of the blank material to be the flange portion with a first punch, and the second forming step clamps a region of the preformed part to be the top portion with the pad and a second die and performs forming with a second punch that lies along a shape including the trough portion of the preformed part.

Advantageous Effects of Invention

According to the present invention, the problem of potential wrinkles in shrink-flanging can be fundamentally solved without any adverse effects on the final products.

DESCRIPTION OF EMBODIMENTS

With reference to the accompanying drawings, the following describes in detail a press forming method according to exemplary embodiments of the present invention. Note that the embodiments are not intended to limit the scope of the invention.

The inventor has earnestly investigated a solution of fundamentally alleviating the focusing of shrinkage on an end portion of a projecting bend of a flange portion in shrink-flanging. As a consequence, the inventor has conceived that, if the shrinkage and stretch arise simultaneously and are offset to each other at the end portion of the projecting bend of the flange portion at the time of press forming the flange portion, neither large shrinkage deformation would arise at the end portion of the projecting bend nor wrinkles would be formed at that region. The inventor has then examined a press forming method in which the shrinkage and stretch would arise simultaneously at the end portion of the projecting bend of the flange portion. The following describes the details of examination based on FIGS. 22A to 26.

Figure 22A:
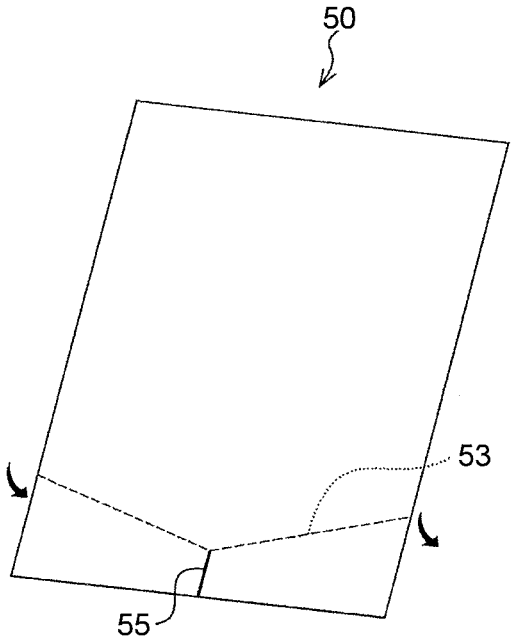
FIG. 22A is a diagram for explaining a mechanism of a press forming method according to the invention.
Figure 22B:
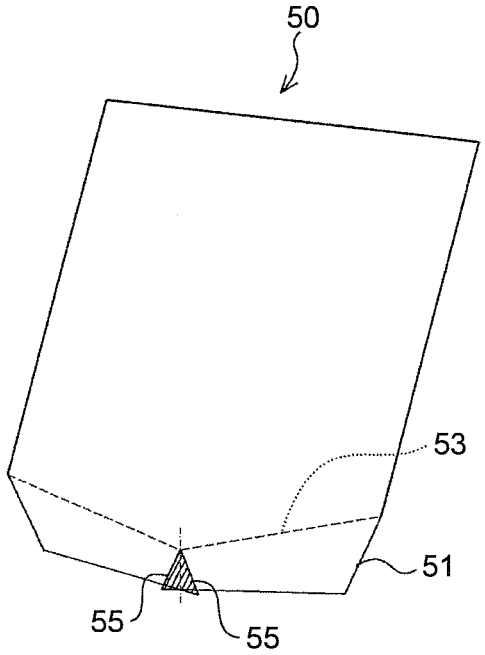
FIG. 22B is a diagram for explaining the mechanism of the press forming method in the invention.

FIG. 22A is a diagram illustrating a first blank 50 of a flat sheet shape. A broken line indicates a first bend line 53 to form a first flange portion 51 (see FIG. 22B), and a bold solid line at the center indicates a first slit 55 made to the sheet. When such a first blank 50 is bent along the first bend line 53 and the first flange portion 51 is formed, as illustrated in FIG. 22B, the portions of the first slit 55 in the first flange portion 51 overlap. Thus, when the first slit 55 is not present on the first blank and the sheet is not split, in the first flange portion 51, shrinkage arises in the region indicated by hatched lines in FIG. 23, and when the shrinkage is not absorbed by the increase in sheet thickness, wrinkles arise. This is the shrink-flanging.

Figure 24A:
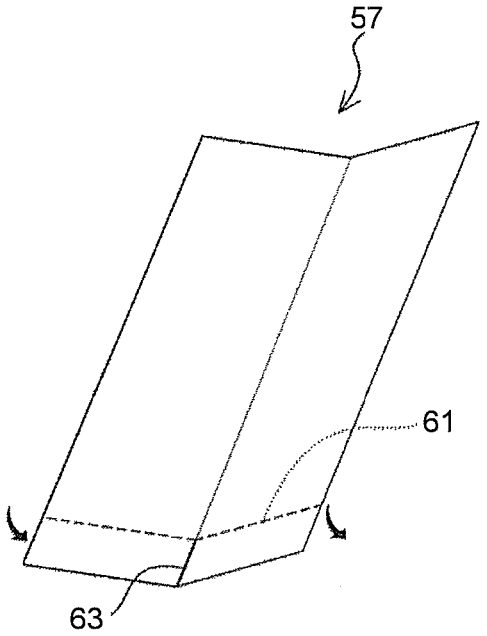
FIG. 24A is a diagram for explaining the mechanism of the press forming method in the invention.
Figure 24B:
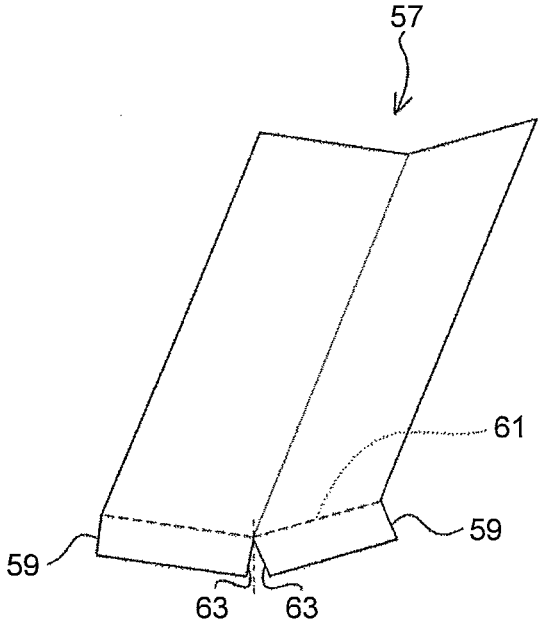
FIG. 24B is a diagram for explaining the mechanism of the press forming method in the invention.

FIG. 24A is a diagram illustrating a second blank 57 in which a rectangular sheet is formed in a trough shape at its center. A broken line indicates a second bend line 61 to form a second flange portion 59, and a bold solid line at the center indicates a second slit 63 made to the sheet. When such a second blank 57 is bent along the second bend line 61 and the second flange portion 59 is formed, as illustrated in FIG. 24B, a part of the blank opens at the center of the second flange portion 59. Thus, when the second slit 63 is not present on the second blank and the sheet is not split, in the second flange portion 59, a stretch arises in the region indicated by hatched lines in FIG. 25, and when the stretch is large, a crack arises. This is the stretch-flanging.

As described above, as illustrated in FIG. 23, when the first blank 50 of a flat sheet shape is bent along the projecting first bend line 53 having a part of its outer edge projecting outward, and the first flange portion 51 is formed, the shrinkage arises in the bend end portion of the first flange portion 51. Furthermore, as illustrated in FIG. 25, when the second blank 57 of a trough shape is bent along the second bend line 61 crossing the trough and the second flange portion 59 is formed along the trough, the stretch arises in the bend end portion of the second flange portion 59.

Consequently, by simultaneously causing shrinkage and stretch on the same portion of such a flange portion during the press forming, the shrinkage and stretch are offset. To do this, the flange portion only needs to be formed by bending along a bend line that provides the two characteristics of the first bend line 53 that projects outward as illustrated in FIG. 23 and the second bend line 61 that lies along the trough shape illustrated in FIG. 25.

To perform such press forming, a preliminary intermediate shape (preformed shape) by which the bend line having the two characteristics is achieved only needs to be formed at a stage prior to the press forming of the flange portion of a target shape. FIG. 26 is a diagram illustrating one example of such a preformed shape. This preformed shape 65 is in a shape including a top portion 69, a vertical wall portion 71, and a trough portion 73. The top portion 69 includes a projecting outer edge 67 a part of which projects outward. The vertical wall portion 71 is formed by bending along the projecting outer edge 67 of the top portion 69, and constitutes a part of the flange portion. The trough portion 73 is bent outward from the vertical wall portion 71 and is recessed on the top portion 69 side. In the preformed shape 65 illustrated in FIG. 26, a third bend line 75 formed on the vertical wall portion 71 is the bend line that provides the foregoing two characteristics. That is, because the preformed shape 65 projects outward when viewed from above, the third bend line 75 is in the same shape as that of the first bend line 53 in FIG. 23. Furthermore, because the preformed shape 65 is in a trough shape when viewed from the front, the third bend line 75 is in the same shape as that of the second bend line 61 in FIG. 25.

Figure 23:
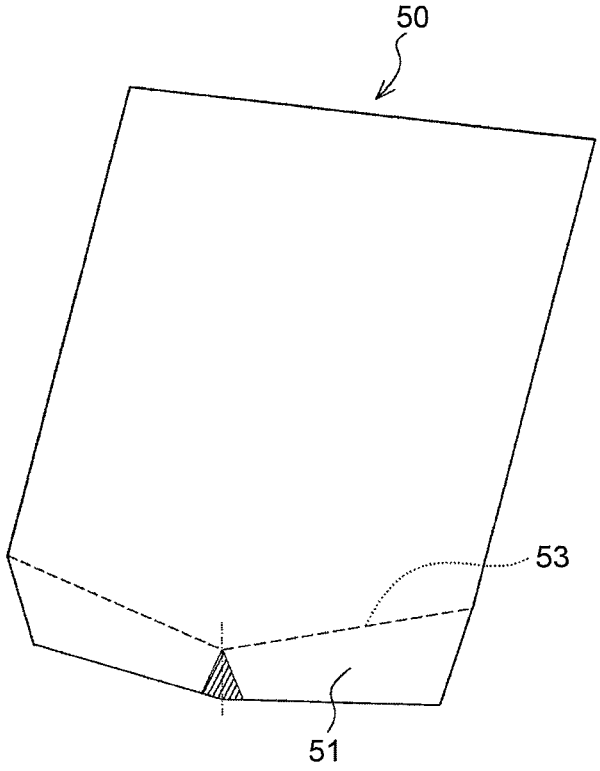
FIG. 23 is a diagram for explaining the mechanism of the press forming method in the invention.
Figure 25:
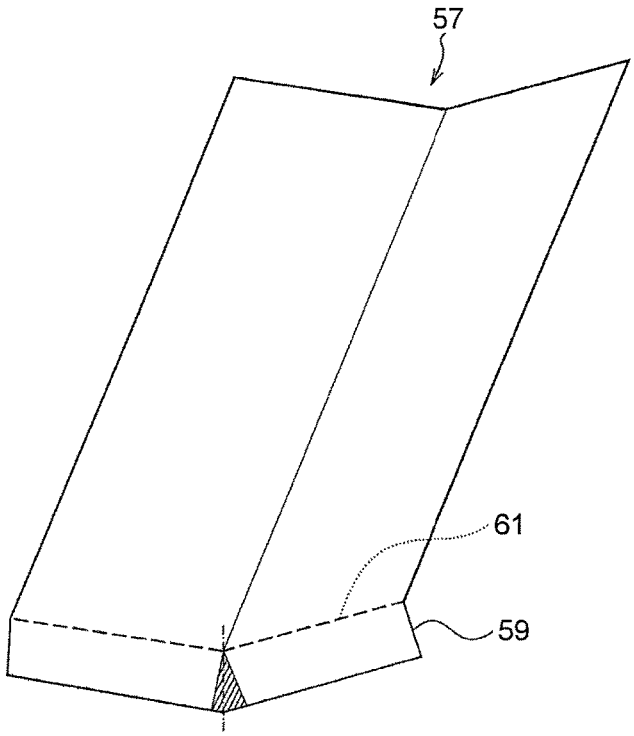
FIG. 25 is a diagram for explaining the mechanism of the press forming method in the invention.
Figure 26:
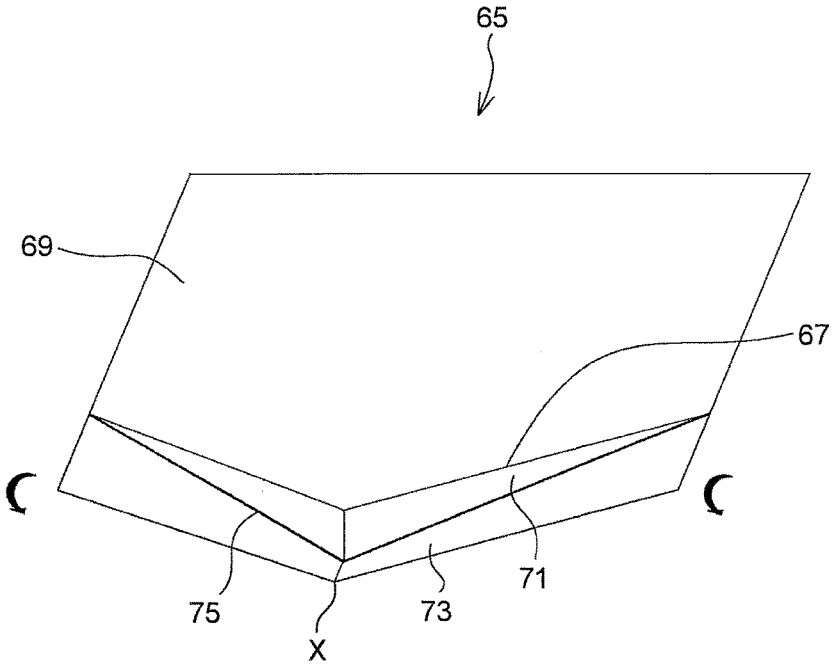
FIG. 26 is a diagram for explaining the mechanism of the press forming method in the invention.

When the preformed shape 65 is formed and, as indicated by arrows in FIG. 26, the trough portion 73 is formed along the third bend line 75 of the vertical wall portion 71 that has appeared on the preformed shape 65, in the X portion at the end of the center of the trough portion 73, the shrinkage illustrated in FIG. 23 and the stretch illustrated in FIG. 25 arise at the same time. As a result, the shrinkage and the stretch are offset, and wrinkles attributable to the shrinkage and cracks attributable to the stretch do not arise. While the shrinkage arises at the center (the projecting portion of the projecting shape) of the vertical wall portion 71 when the preformed shape 65 is formed, because the drooping distance from the top portion 69 is short at that region, the shrinkage is not severe and is not a matter. The present invention is based on the foregoing findings, and specifically, is composed of the following constituents.

Figure 2:
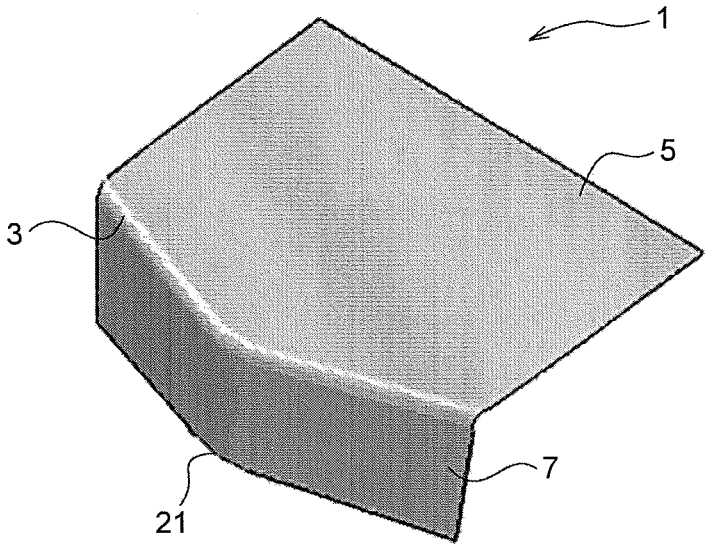
FIG. 2 is a diagram for explaining a formed part formed by the press forming method in the one embodiment of the invention.

A press forming method according to one embodiment of the invention is a press forming method in which a formed part 1 illustrated in FIG. 2 is press-formed. The formed part 1 includes a top portion 5 that has a projecting outer edge 3 a part of which projects outward and a flange portion 7 that is formed by bending along the projecting outer edge 3 of the top portion 5.

The press forming method in the present embodiment includes a first forming process S1 and a second forming process S2. In the first forming process S1 (FIGS. 1A and 1B), at a region of a blank material 9 in which the flange portion 7 is formed, a preformed part 15 (see FIGS. 1B and 3) is formed including a vertical wall portion 11 that is to be a part of the flange portion 7, and a trough portion 13 that is bent outward from the vertical wall portion 11 and recessed downward. In the second forming process S2 (FIGS. 10 and 1D), a second punch 35 that lies along the shape of the preformed part 15 including the trough portion 13, which was formed in the first forming process S1, performs bending-forming on the region including the trough portion 13 along a boundary line 19 (see FIG. 3) with the vertical wall portion 11, and forms the flange portion 7 (see FIG. 1D). In the following description, the formed part 1 that is the target shape of the press forming method in the embodiment, the first forming process S1, and the second forming process S2 will be described in detail.

Press Formed Part

The press formed part 1 that is the target shape of press forming in the embodiment, as illustrated in FIG. 2, includes the top portion 5 that has the projecting outer edge 3 a part of which projects outward and the flange portion 7 that is formed by bending along the projecting outer edge 3 of the top portion 5. In the formed part 1 of such a shape, shrinkage is focused on a bend end portion 21 of the flange portion 7 and wrinkles are likely to form in that region.

First Forming Process

The first forming process S1 in the embodiment is a process in which the preformed part 15 (see FIG. 3) is formed. The preformed part 15 includes, at the region of the blank material 9 in which the flange portion 7 is formed, the vertical wall portion 11 that is to be a part of the flange portion 7 and the trough portion 13 that is bent outward from the vertical wall portion 11 and recessed on the top portion 5 side.

Figure 1A:
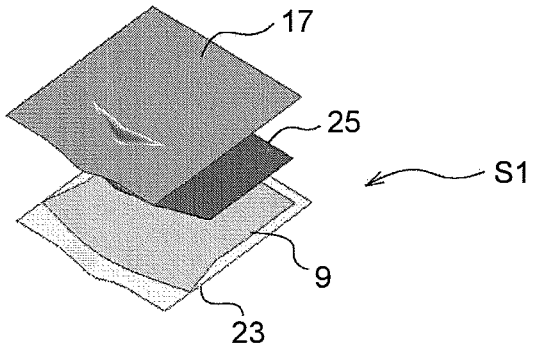
FIG. 1A is a diagram for explaining a first forming process in a press forming method according to one embodiment of the invention.
Figure 1B:
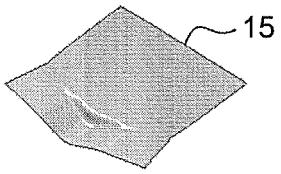
FIG. 1B is a diagram for explaining a preformed part by the first forming process in the press forming method in the one embodiment of the invention.

In the press forming in the first forming process S1, as illustrated in FIG. 1A, a first die 23 that is a lower die, a first punch 17 that comes down from above the die, and a pad 25 that holds down the blank material 9 are used.

Figure 4:
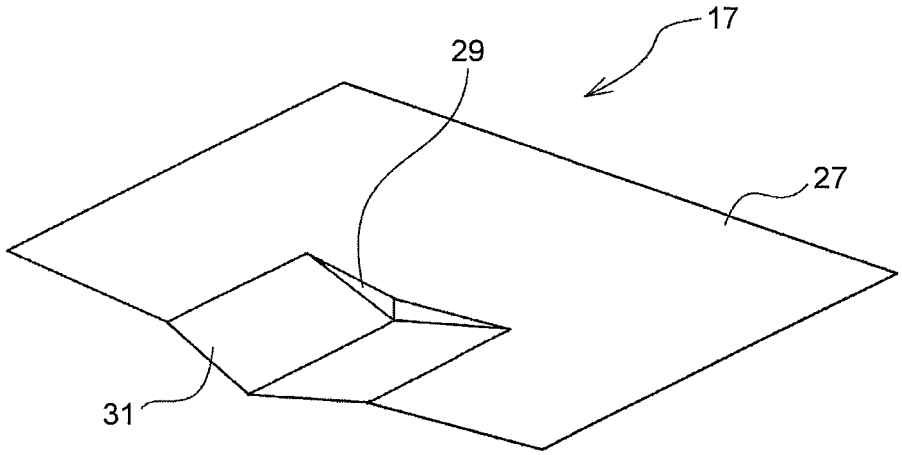
FIG. 4 is a diagram for explaining a first punch used in the first forming process of the press forming method in the one embodiment of the invention.

The first punch 17, as illustrated in FIG. 4, includes a flat portion 27, a vertical-wall forming portion 29, and a trough forming portion 31. The flat portion 27 is positioned at the region corresponding to the top portion 5 of the formed part 1. The vertical-wall forming portion 29 forms the vertical wall portion 11 extending downward along the projecting outer edge 3 of the preformed part 15. The trough forming portion 31 extends from the vertical-wall forming portion 29 in the horizontal direction and forms the trough portion 13 for which the upside is recessed.

The first die 23 has a shape corresponding to the shapes of the respective forming portions of the first punch 17. It is preferable that the pressing force of the pad 25 pressing the blank material 9 to the first die 23 be a pressure strong enough to cause no deformation on the top portion 5 at the time of forming by moving down the first punch 17.

The first forming process S1 will be described more specifically. In the first forming process S1, as illustrated in FIG. 1A, in a state of the first die 23 and the pad 25 clamping the blank material 9, the first punch 17 moves down toward the first die 23. When the first punch 17 moves down, the center of the trough forming portion 31 of the first punch 17 comes into contact with the blank material 9 first. When the first punch 17 further moves down, the forming of the trough portion 13 and the forming of the vertical wall portion 11 are simultaneously performed in sequence from the center of the blank material 9.

Figure 13:
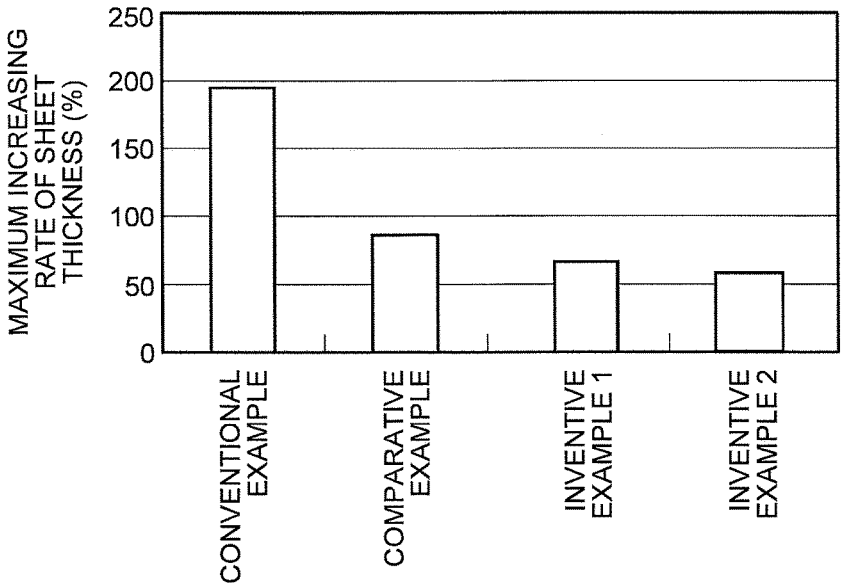
FIG. 13 is a chart for explaining the effects in the examples of the invention.

As in the foregoing, by the first forming process S1, the trough portion 13 is formed, and on the vertical wall portion 11, the boundary line 19 with the trough portion 13 is formed (see FIG. 13). The boundary line 19 has the same characteristics as that of the third bend line 75 that is illustrated in FIG. 26, that is, the characteristics that cause the shrinkage and stretch to arise simultaneously in the bend end portion 21 of the flange portion 7.

Second Forming Process

Figure 1C:
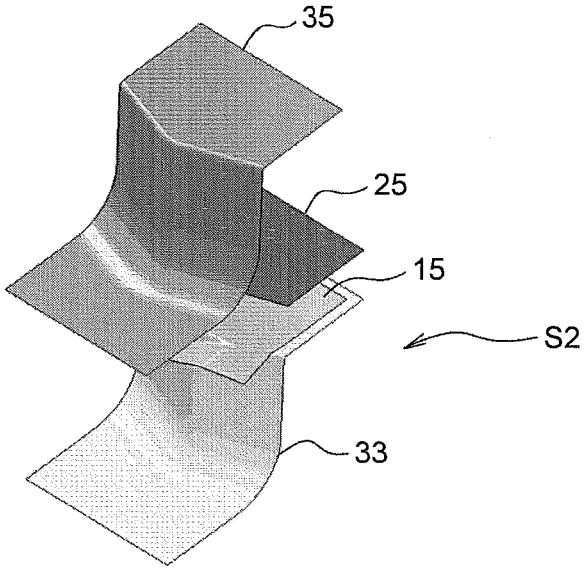
FIG. 1C is a diagram for explaining a second forming process in the press forming method in the one embodiment of the invention.

In the second forming process S2, as illustrated in FIG. 1C, a second die 33 and the pad 25 clamp the preformed part 15 that was formed in the first forming process S1, and the second punch 35 bends the region including the trough portion 13 downward along the boundary line 19 (see FIG. 3) and forms the flange portion 7.

Figure 5:
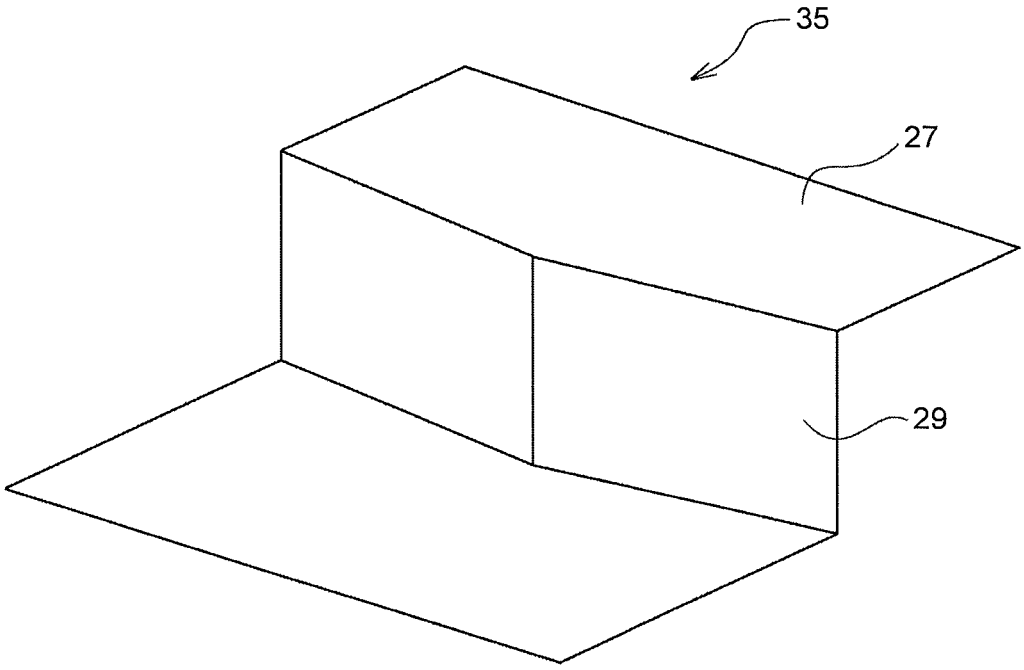
FIG. 5 is a diagram for explaining a second punch used in the second forming process of the press forming method in the one embodiment of the invention.

The second punch 35 used in the second forming process S2, as illustrated in FIG. 5, has the vertical-wall forming portion 29 that lies along the vertical wall portion 11 formed in the first forming process S1. The second die 33 (FIG. 1C) has a vertical wall portion in the same shape as that of the flange portion 7 that is the target.

Figure 1D:
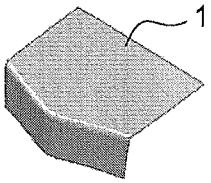
FIG. 1D is a diagram for explaining a target shape formed by the second forming process in the press forming method in the one embodiment of the invention.

When the second punch 35 as illustrated in FIG. 5 moves down along the vertical wall portion 11 formed in the first forming process S1, the shape including the trough portion 13 is bent downward in a vertical direction from the boundary line 19 with the vertical wall portion 11 and formed, and the target shape is formed as illustrated in FIG. 1D.

In the second forming process S2, the shape including the trough portion 13 formed in the first forming process S1 is bent downward along the boundary line 19 and formed. At this time, both the shrinkage and stretch act on the lower end portion at the center of the flange portion 7 but are offset to each other, and hence large shrinkage never arises, let alone wrinkles, by this bending-forming.

Figure 6:
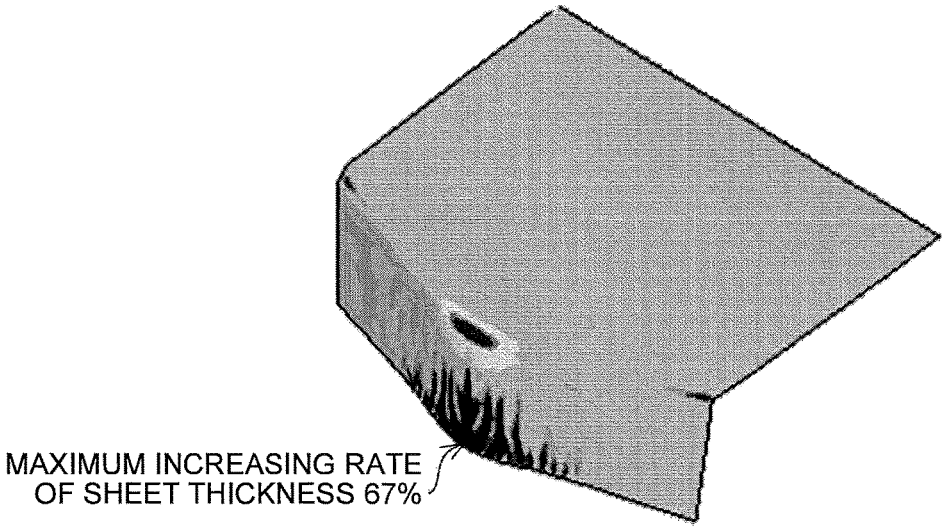
FIG. 6 is a contour diagram illustrating an increasing rate of sheet thickness in the second forming process of the press forming method in the one embodiment of the invention.

FIG. 6 is a contour diagram (distribution map) illustrating the distribution of sheet thickness after the second forming process S2. As illustrated in FIG. 6, sheet-thickness increased regions are dispersed in a wide area, and even in a region of the highest increasing rate of sheet thickness, the increasing rate of sheet thickness was 67%. This means that the action of offsetting the shrinkage and stretch reduces the maximum value of the increasing rate of sheet thickness and reliably prevents wrinkles from arising. Note that the increase in sheet thickness arises at the bend end portion 21 (FIG. 2) of the flange portion 7 even by the method of the invention. This is because the shrinkage and stretch arising in that region do not necessarily correspond to each other perfectly.

Figure 7:
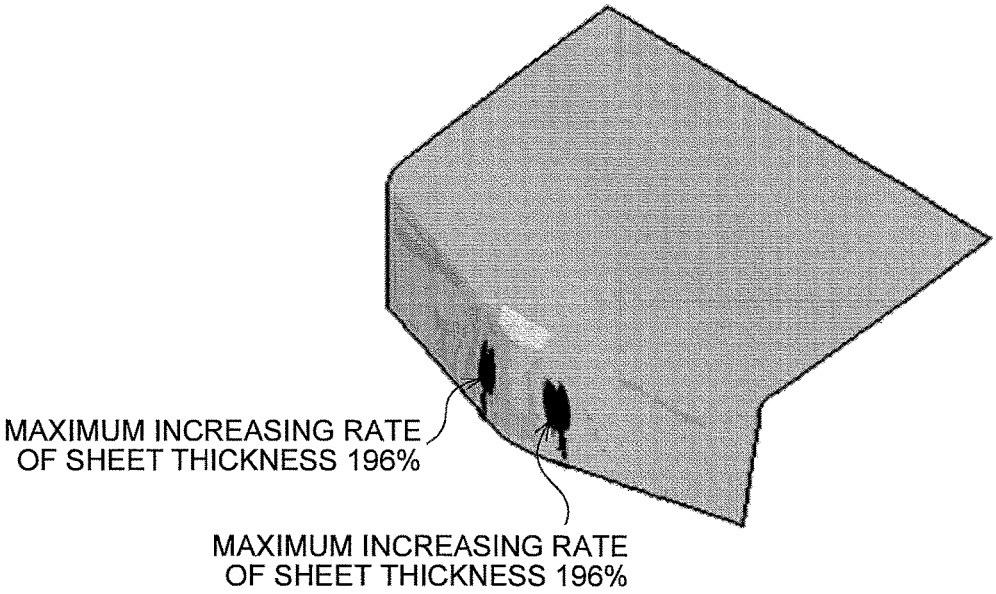
FIG. 7 is a contour diagram illustrating the increasing rate of sheet thickness when forming is performed by a conventional press forming method.

FIG. 7 is a contour diagram illustrating the distribution of sheet thickness when press forming was performed by a conventional press forming method in which shrink-flanging was performed in a single process. Comparison of FIG. 7 with FIG. 6 tells that, in the conventional method (FIG. 7), the regions in which changes in sheet thickness arise are not as dispersed in a wide area of the flange portion 7 as illustrated in FIG. 6 (the invention), and are focused on two places at the center. The maximum increasing rate of sheet thickness in the conventional method illustrated in FIG. 7 is 196%, and is greater than 67% of the invention illustrated in FIG. 6.

Figure 3:
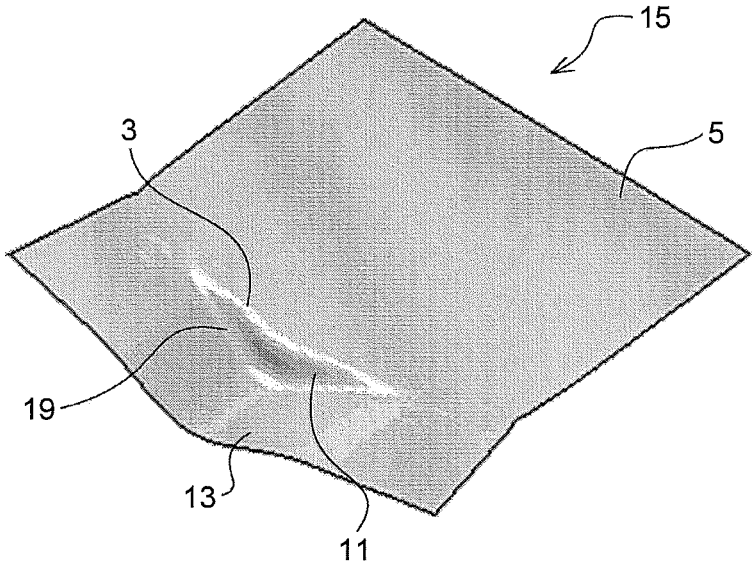
FIG. 3 is a diagram for explaining a preformed part formed by the first forming process in the press forming method in the one embodiment of the invention.

As in the foregoing, in the present embodiment, as illustrated in FIG. 3, in the first forming process S1, at the region of the blank material 9 in which the flange portion 7 is formed, the preformed part 15 is formed that includes the vertical wall portion 11 that is to be a part of the flange portion 7 and the trough portion 13 that is bent outward from the vertical wall portion 11 and recessed on the top portion 5 side. Then, in the second forming process S2, the part of the preformed part 15 including the trough portion 13 formed in the first forming process S1 is formed by bending along the boundary line 19 with the vertical wall portion 11 and the flange portion 7 of the formed part 1 of the final shape is formed. Thus, in the second forming process, the shrinkage and stretch are offset at the bend end portion 21 of the flange portion 7, and the shrink-flanging can be performed without forming large shrinkage. Consequently, the formed part 1 excellent in shape accuracy can be manufactured easily.

Figure 8:
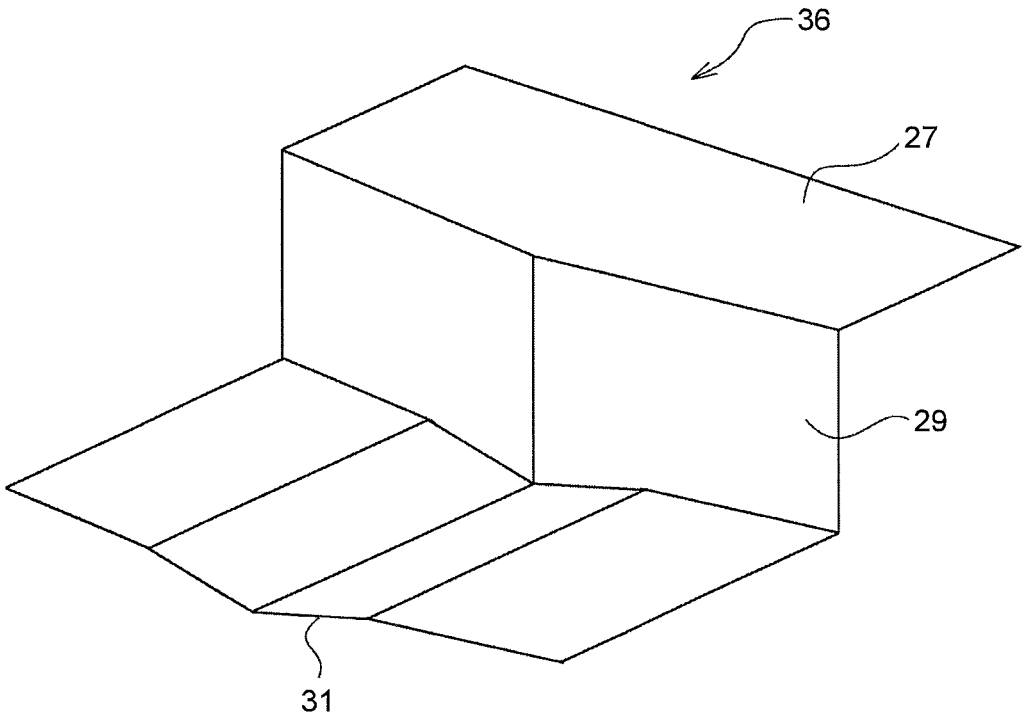
FIG. 8 is a diagram for explaining a second punch used in a second forming process of a press forming method according to another embodiment of the invention.

The second punch, as illustrated in FIG. 8, may have the trough forming portion 31 that lies along the trough portion 13 in addition to the vertical-wall forming portion 29 that lies along the vertical wall portion 11 of the preformed part 15 formed in the first forming process S1. When this second punch 36 moves down along the vertical wall portion 11 formed in the first forming process S1, the second punch 36 comes into contact with the shape including the trough portion 13. When the second punch 36 moves further down, the shape including the trough portion 13 is bent downward in the vertical direction from the boundary line 19 with the vertical wall portion 11 and formed, and the target shape is formed.

Examples

Figure 9:
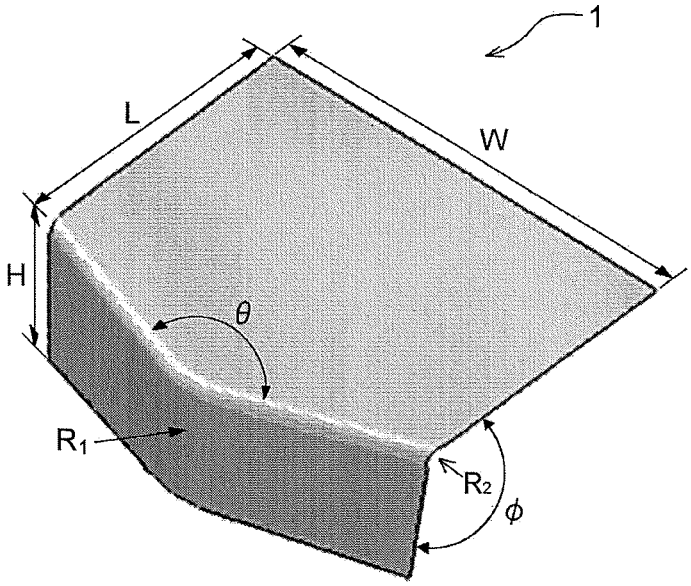
FIG. 9 is a diagram for explaining a formed part in examples of the invention.

To verify the effects of the invention, the conventional method and the method of the invention have been verified by analyzing by the finite element method. The software used in the analysis was LS-DYNA version 971 by Livermore Software Technology Corporation (LSTC), and a dynamic explicit method solver was used. As the material to be processed, a high-strength steel sheet of a sheet thickness of 1.2 mm and a tensile strength of 590 MPa class was assumed. FIG. 9 is a diagram illustrating the shape of a formed part to be the target. Table 1 is a table indicating the dimensions and such of the various portions of the formed part illustrated in FIG. 9.

TABLE 1

| W (mm) | L (mm) | H (mm) | θ (deg.) | ϕ (deg.) | $R_1$ (mm) | $R_2$ (mm) |
|---|---|---|---|---|---|---|
| 150 | 100 | 50 | 140 | 90 | 30 | 5 |

Figure 10:
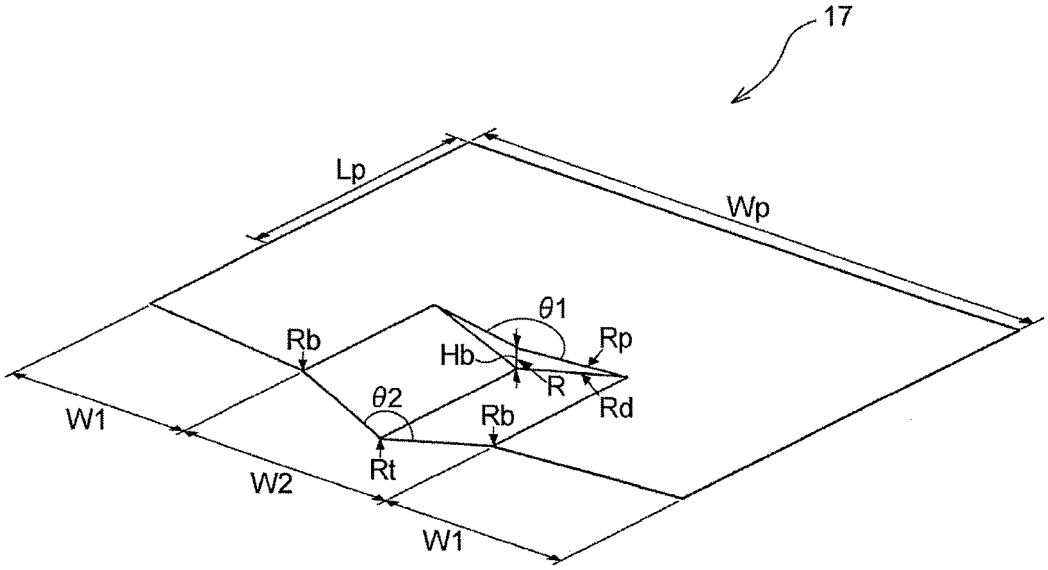
FIG. 10 is a diagram for explaining a first punch in the examples of the invention.
Figure 11:
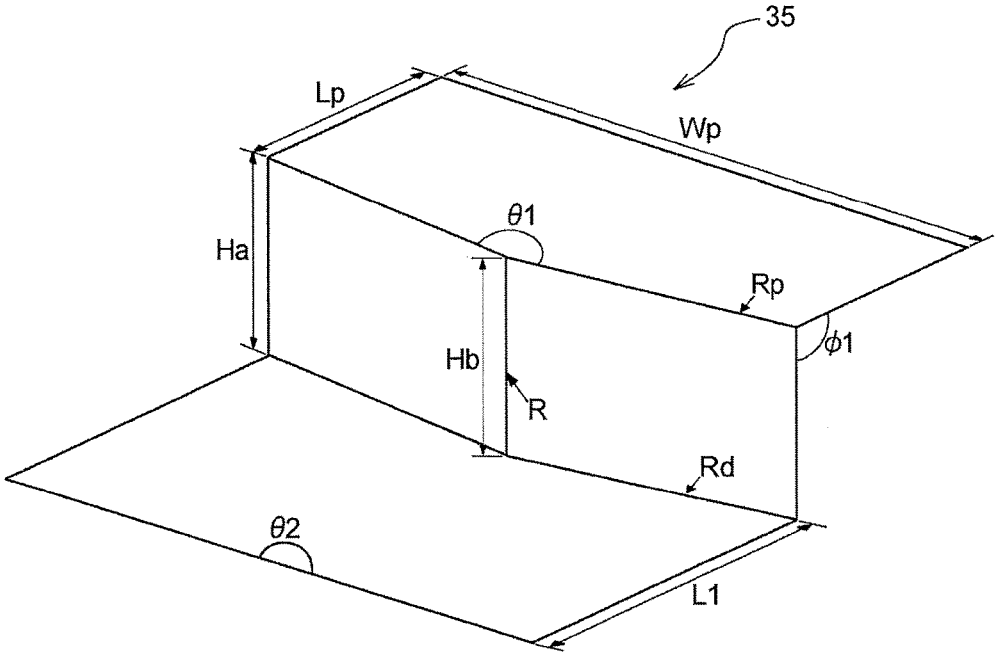
FIG. 11 is a diagram for explaining a second punch in the example of the invention.
Figure 12:
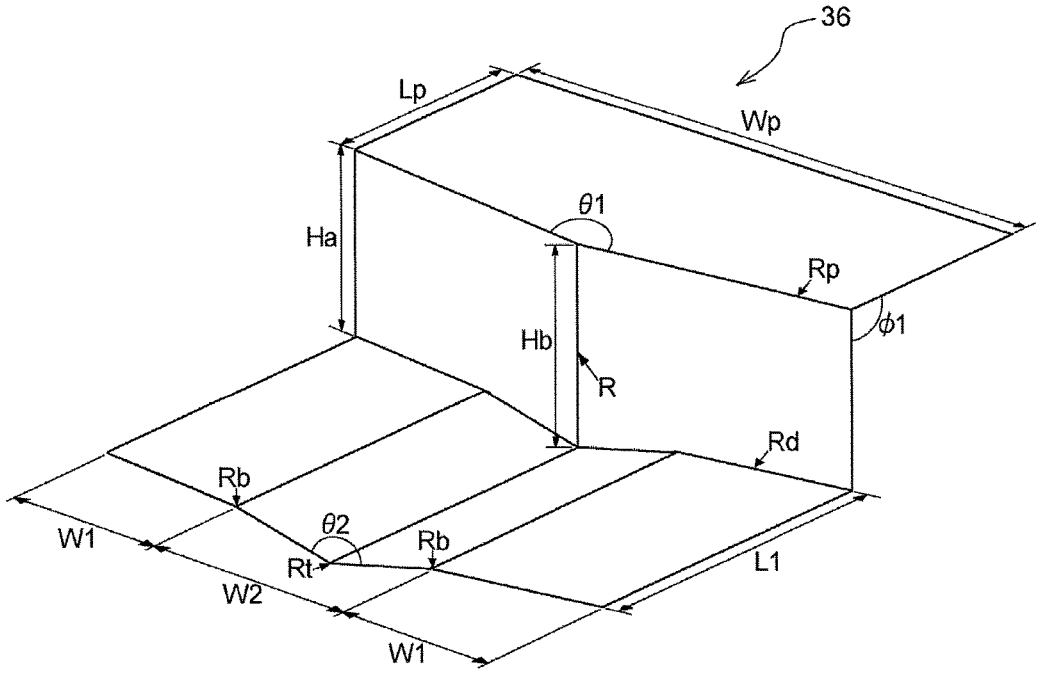
FIG. 12 is a diagram for explaining a second punch in the example of the invention.

FIG. 10 is a diagram illustrating the first punch used in the first forming process of the invention. FIGS. 11 and 12 are diagrams illustrating the second punch used in the second forming process. Table 2 is the tables indicating the dimensions of the various portions of the first punch and the second punch. The situation in which the second punch illustrated in FIG. 11 was used is defined as an inventive example 1 and the situation in which the second punch illustrated in FIG. 12 was used is defined as an inventive example 2. The pressing force by the respective pads was 196 MN, and the press forming speed was 2 m/sec.

TABLE 2

| | Wp (mm) | Lp (mm) | Ha (mm) | Hb (mm) | W1 (mm) | W2 (mm) | L1 (mm) | θ1 (deg.) | θ2 (deg.) | ϕ1 (deg.) | R (mm) | Rp (mm) | Rt (mm) | Rb (mm) | Rd (mm) |
|---|---|---|---|---|---|---|---|---|---|---|---|---|---|---|---|
| <INVENTIVE EXAMPLE 1> | | | | | | | | | | | | | | | |
| 1st Punch | 170 | 110 | 0 | 12.7 | 40 | 90 | — | 140 | 140 | 90 | 30 | 5 | 30 | 60 | 5 |
| 2nd Punch | 170 | 110 | 100 | 100 | — | — | 180 | 140 | 180 | 90 | 30 | 5 | — | — | 50 |
| <INVENTIVE EXAMPLE 2> | | | | | | | | | | | | | | | |
| 1st Punch | 170 | 110 | 0 | 12.7 | 40 | 90 | — | 140 | 140 | 90 | 30 | 5 | 30 | 60 | 5 |
| 2nd Punch | 170 | 110 | 100 | 112.7 | 40 | 90 | 180 | 140 | 180 | 90 | 30 | 5 | 30 | 60 | 5 |

FIG. 13 is a chart illustrating maximum increasing rates of sheet thickness at the bottom dead point of press forming when different press forming methods were performed. In FIG. 13, the conventional example is the press forming method in which shrink-flanging is performed in a single process and the comparative example is the press forming method in which the shrink-flanging is performed in a single process by using a punch of the same shape as that of the second punch 36 illustrated in FIG. 12. As illustrated in FIG. 13, the maximum increasing rates of sheet thickness were, in contrast to 196% in the conventional example and 87% in the comparative example, 67% in the inventive example 1 and 59% in the inventive example 2. Thus, in accordance with the press forming method of the invention, as compared with the conventional example and the comparative example, it has been verified that the maximum increasing rate of sheet thickness is reduced. This means that wrinkles are effectively prevented from arising by the shrink-flanging of the press forming method of the invention. As for the inclination angle of the trough portion 13, it only needs to be set such that the deformation becomes the smallest considering the offset of the shrinkage and stretch that arise at the bend end portion of the flange portion in relation to the projecting portion of the flange portion to be formed.

In the above-described embodiment, the situation in which the top portion 5 of the formed part was flat has been exemplified. However, the top portion 5 of the formed part formed by the press forming method of the invention is not necessary to be flat. For example, the top portion 5 may be of a recessed shape having inclined surfaces inclined downward toward the center, or in reverse, the top portion 5 may be of a projecting shape having inclined surfaces inclined upward toward the center.

Figure 14:
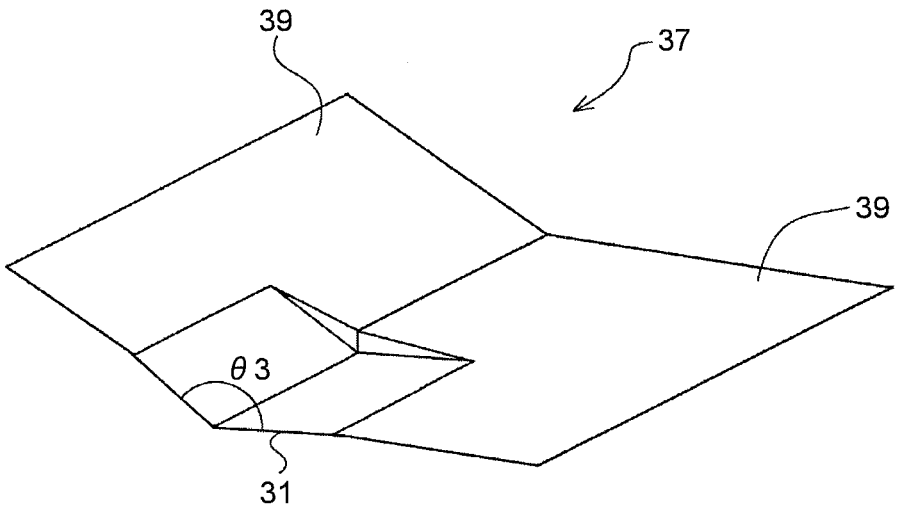
FIG. 14 is a diagram for explaining a first punch used in a first forming process of a press forming method according to another embodiment of the invention.
Figure 15:
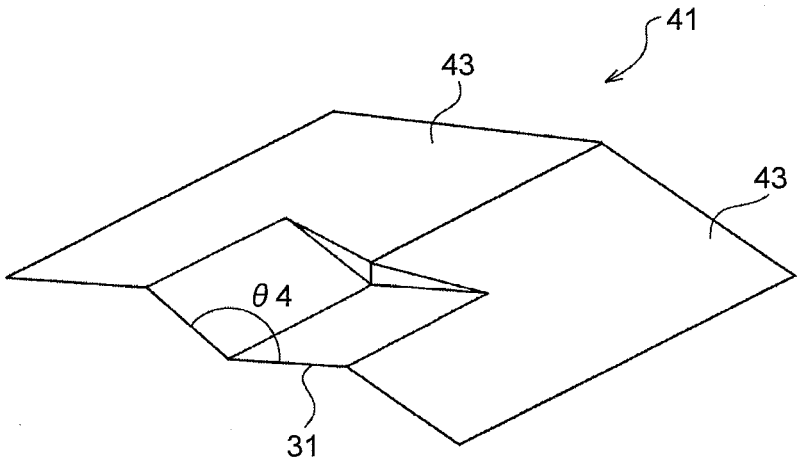
FIG. 15 is a diagram for explaining a first punch used in a first forming process of a press forming method according to yet another embodiment of the invention.

As illustrated in FIG. 14, a top-portion forming portion 39 of a first punch 37 when the top portion 5 is of a recessed shape is of a recessed shape composed of inclined surfaces that are inclined downward toward the center, and it is desirable that an inclined angle θ3 of the trough forming portion 31 be smaller than an inclined angle θ2 when the top portion 5 is flat. As illustrated in FIG. 15, a top-portion forming portion 43 of a first punch 41 when the top portion 5 is of an upward projecting shape is of a projecting shape composed of inclined surfaces that are inclined upward toward the center, and it is desirable that an inclined angle θ4 of the trough forming portion 31 be greater than the inclined angle θ2 when the top portion 5 is flat.

Figure 16:
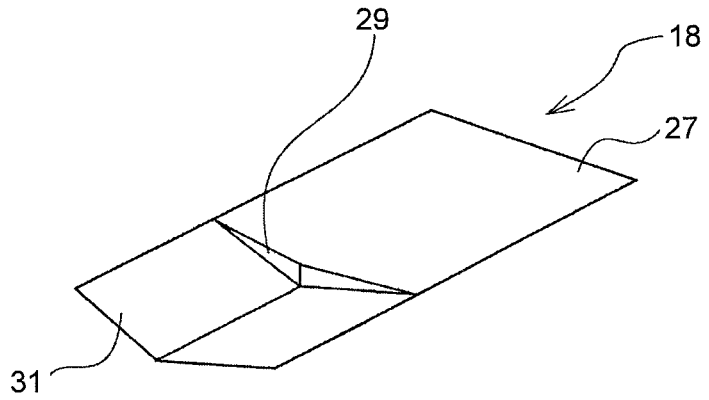
FIG. 16 is a diagram for explaining a first punch used in a first forming process of a press forming method according to still another embodiment of the invention.
Figure 17:
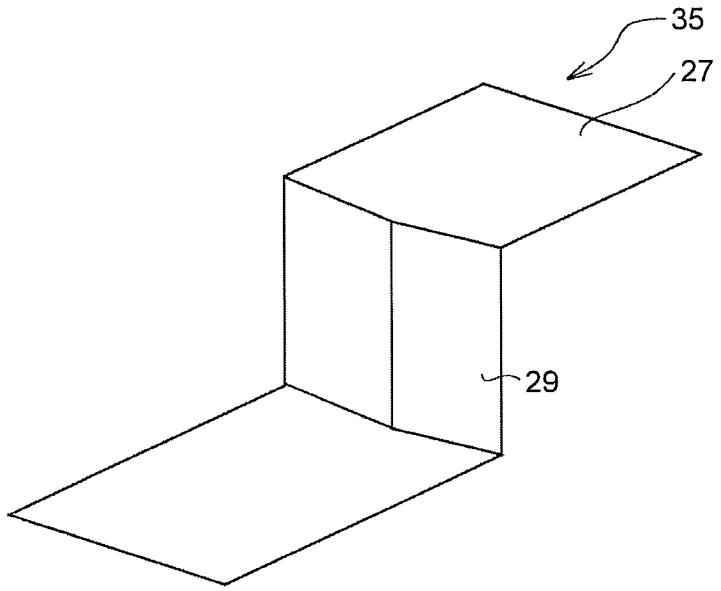
FIG. 17 is a diagram for explaining a second punch used in a second forming process of the press forming method in the other embodiment of the invention.

In the above-described embodiment, in the preformed part 15, the trough portion 13 is formed at a part of the blank material 9 in the width direction. However, it may be formed extending over the entire width of the blank material 9. FIG. 16 is a diagram illustrating a first punch 18 when the trough portion 13 of the preformed part 15 is formed extending over the entire width of the blank material 9. FIG. 17 is a diagram illustrating a second punch 35 in this case. When the trough portion 13 is formed extending over the entire width of the blank material 9, it is preferably applied to the blank material 9 of a narrow width because it is difficult to apply it to the blank material 9 of a wide width.

Figure 18:
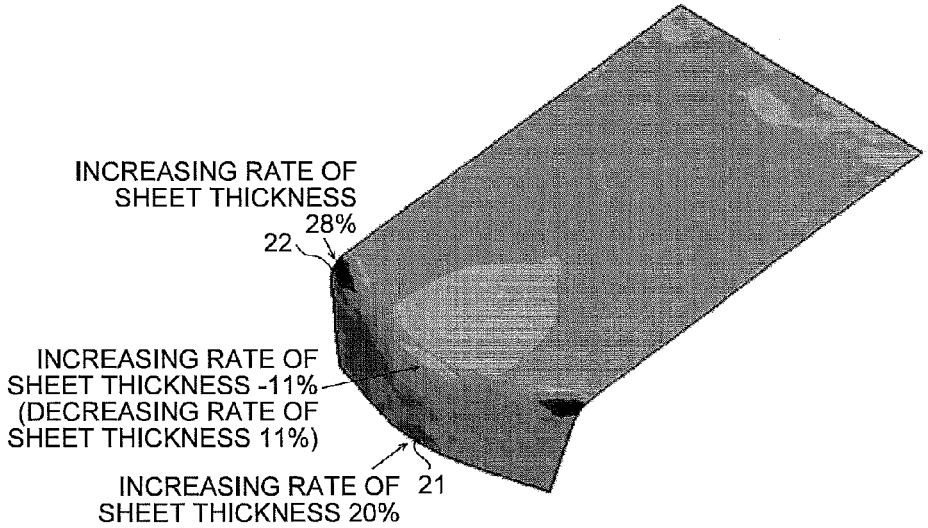
FIG. 18 is a contour diagram illustrating the increasing rate of sheet thickness in the second forming process of the press forming method in the one embodiment for a narrow-width blank material of the invention.
Figure 19:
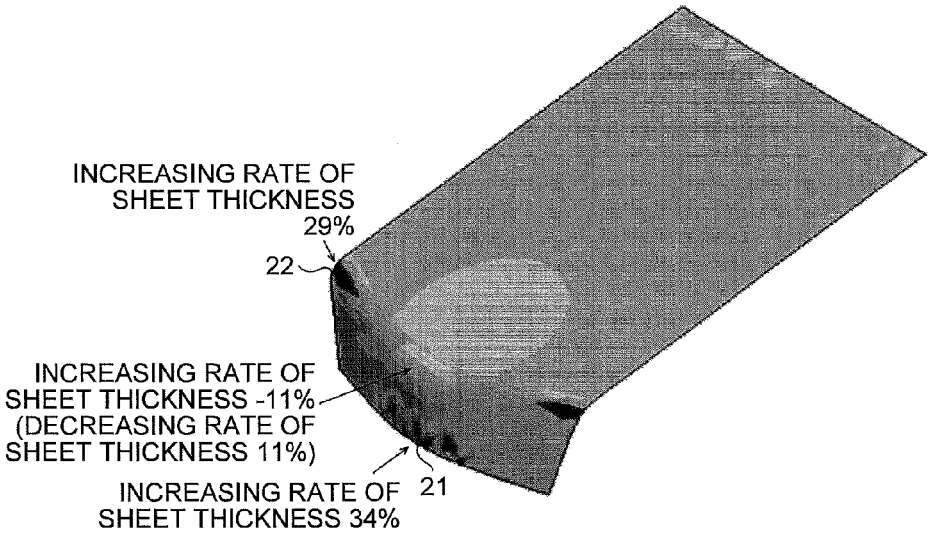
FIG. 19 is a contour diagram illustrating the increasing rate of sheet thickness by the conventional press forming method for a narrow-width blank material.

FIG. 18 is a contour diagram illustrating the result of analysis the same as that of the above-described examples performed on the press forming using the first punch 18 illustrated in FIG. 16 and the second punch 35 illustrated in FIG. 17. FIG. 19 is a contour diagram illustrating the analysis result of a conventional example. When the trough portion 13 was formed extending over the entire width of the blank material 9 of a narrow width, the increasing rate of sheet thickness arising at the bend end portion 21 of the flange portion 7 was 20% as illustrated in FIG. 18 in accordance with the press forming method of the invention while it was 34% as illustrated in FIG. 19 in accordance with the conventional example. As just described, it has been verified that, even when the trough portion 13 is formed extending over the entire width of the blank material 9, as the same as that when the trough portion 13 is formed at a part of the width of the blank material 9, the increasing rate of sheet thickness at the bend end portion 21 of the flange portion 7 is reduced.

Note that sheet-thickness increased regions arose at both ends of a base portion 22 of the flange portion 7 (both end portions of the boundary between the top portion 5 and the flange portion 7). This is because the width of the blank material 9 was narrower than the width of the blank material 9 in which the trough portion 13 was formed in a part of the width of the blank material 9 in the above-described embodiment, and both ends of the base portion 22 of the flange portion 7 were easy to deform when the shrink-flanging was performed, resulting in the increase in sheet thickness at those regions. That is, the stress acting on the bend end portion 21 of the flange portion 7 acted on the regions that would be easy to deform, resulting in the deformation (increase in sheet thickness). It is presumable that this tendency increases as the height of the flange portion 7 increases. Consequently, the analyses have been performed on situations in which the height of the flange portion 7 was increased to 30 mm that was 5 mm higher than that of the examples in FIGS. 18 and 19 (flange height of 25 mm).

Figure 20:
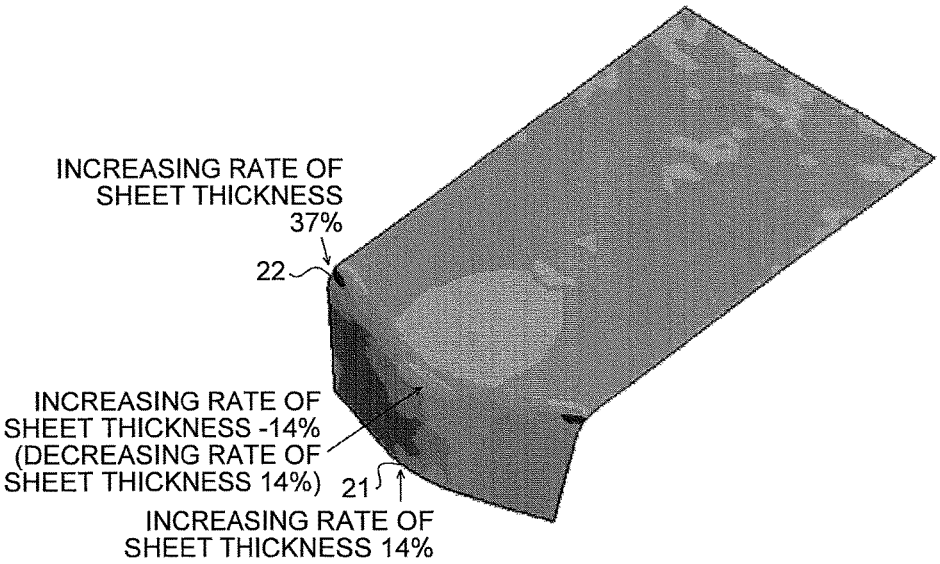
FIG. 20 is a contour diagram illustrating the increasing rate of sheet thickness in the second forming process of the press forming method in the one embodiment of the invention for a narrow-width blank material with an increased flange height.
Figure 21:
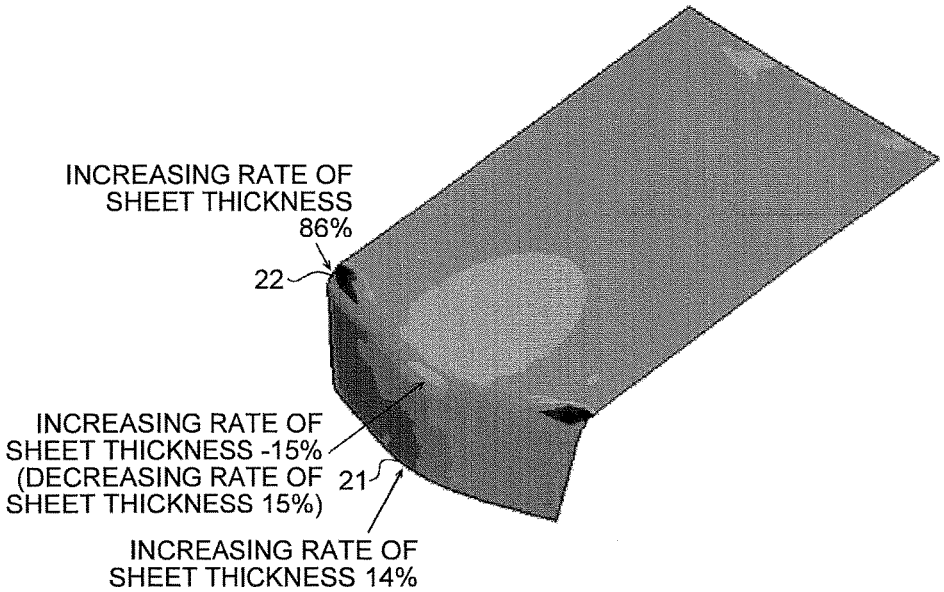
FIG. 21 is a contour diagram illustrating the increasing rate of sheet thickness by the conventional press forming method for a narrow-width blank material with an increased flange height.

FIG. 20 is a contour diagram illustrating the analysis result of the press forming method of the invention when the height of the flange portion 7 is 30 mm, and FIG. 21 is a contour diagram illustrating the analysis result of the conventional example. As illustrated in FIGS. 20 and 21, the increasing rates of sheet thickness arising at the bend end portion 21 of the flange portion 7 in the inventive example and the conventional example were both 14%. On the other hand, the increasing rate of sheet thickness arising at both ends of the base portion 22 was 37% in the inventive example and 86% in the conventional example. As in the foregoing, it has been verified that, when the shrink-flanging is performed on the blank material 9 of a narrow width, according to the inventive example, even though the sheet-thickness increased regions arise on both ends of base portion 22 of the flange portion 7, the increasing rate of sheet thickness at those regions is reduced.

INDUSTRIAL APPLICABILITY

The present invention can be applied to the processing of forming a metal sheet into a shrink flange by press forming. This makes it possible to fundamentally solve the problem of potential wrinkles in shrink-flanging without any adverse effects on the final products.

REFERENCE SIGNS LIST

S1 first forming process
S2 second forming process
1 press formed part
3 projecting outer edge
5 top portion
7 flange portion
9 blank material
11 vertical wall portion
13 trough portion

15 preformed part
17 first punch
19 boundary line
21 bend end portion
22 both ends of base portion
23 first die
25 pad
27 flat portion
29 vertical-wall forming portion
31 trough forming portion
33 second die
35 second punch
37 first punch
39 top-portion forming portion
41 first punch
43 top-portion forming portion
50 first blank
51 first flange portion
53 first bend line
55 first slit
57 second blank
59 second flange portion
61 second bend line
63 second slit
65 preformed shape
67 projecting outer edge
69 top portion
71 vertical wall portion
73 trough portion
75 third bend line

The invention claimed is:

1. A shrink-flanging press forming method of pressing and forming a formed part, the formed part including:

a top portion having a projecting outer edge that projects outward, and a flange portion that extends from the projecting outer edge and that is formed by bending the projecting outer edge, the press forming method comprising:

a first forming step of forming a preformed part from a blank material, the preformed part including:

at least a portion of the projecting outer edge, a vertical wall portion that extends from the at least a portion of the projecting outer edge, and a trough portion that extends from the vertical wall portion, the trough portion being bent outward from the vertical wall portion and being recessed on a side of the top portion, and a second forming step of bending a region of the preformed part that includes the trough portion to form the flange portion such that the vertical wall portion forms a part of the flange portion.

2. The shrink-flanging press forming method according to claim 1, wherein:

the first forming step further includes clamping a region of the blank material with a pad and a first die and forming the preformed part with the pad, the first die, and a first punch, and the second forming step further includes clamping a region of the preformed part with the pad and a second die and forming the formed part with the pad, the second die, and a second punch, the second punch transforming the shape of the trough portion to form the formed part.

3. The shrink-flanging press forming method according to claim 1, wherein:

the vertical wall portion extends from the at least a portion of the projecting outer edge in a first direction, and the trough portion extends from the vertical wall portion in a second direction that is transverse with the first direction.

* * * * *